United States Patent [19]

Braun et al.

[11] Patent Number: 4,926,627

[45] Date of Patent: May 22, 1990

[54] DEVICE TO FEED AND OPEN A FIBER SLIVER ON AN OPEN-END SPINNING DEVICE

[75] Inventors: Erwin Braun, Ingolstadt; Michael Strobel, Munich; Rupert Karl, Ingolstadt, all of Fed. Rep. of Germany

[73] Assignee: Schubert & Salzer Maschinenfabrik Aktiengesellschaft, Ingolstadt, Fed. Rep. of Germany

[21] Appl. No.: 350,214

[22] Filed: May 11, 1989

[30] Foreign Application Priority Data

May 20, 1988 [DE] Fed. Rep. of Germany ..... 3817346

[51] Int. Cl.[5] ..... D01H 7/895; D01G 15/20

[52] U.S. Cl. ..... 57/412; 19/105; 57/408

[58] Field of Search ..... 57/400, 404, 408, 411, 57/412, 90; 19/98, 105

[56] References Cited

U.S. PATENT DOCUMENTS

| | | | |
|---|---|---|---|
| 3,439,488 | 4/1969 | Bucil et al. | 57/412 |
| 3,695,022 | 10/1972 | Landwehrkamp | 57/412 X |
| 3,762,144 | 10/1973 | Didek et al. | 57/412 |
| 3,826,071 | 7/1974 | Grau | 57/412 X |
| 4,024,699 | 5/1977 | Goldammer et al. | 57/412 |

*Primary Examiner*—John Petrakes

*Attorney, Agent, or Firm*—Dority & Manning

[57] ABSTRACT

A device for the feeding and opening of a fiber sliver for an open-end spinning device, having a feeder roll, a pressure roll interacting with the feeder roll and an opening roll. The device includes a tray with two guide walls guiding the fiber sliver between the pressure roll and the opening roll and laterally between themselves. The pressure roll is mounted in the feeding tray which has a supporting surface between the feeding roll and the opening roll, to support the fiber sliver and which is delimited by the guide walls. The opening roll is driven in the same direction of rotation as the feeder roll.

21 Claims, 3 Drawing Sheets

DEVICE TO FEED AND OPEN A FIBER SLIVER ON AN OPEN-END SPINNING DEVICE

BACKGROUND OF THE INVENTION

The instant invention relates to a device to feed and open a fiber sliver on an open-end spinning device, having a feeding roll, a pressure roller interacting with the feeding roll, an opening roll and two guiding walls which guide the fiber sliver between the pressure roller and the opening roll.

In a known device of this type the guide walls are located at a filling body which causes extensive sealing of the space between the nip of the feeding device consisting of a feeding roll and a pressure roller and the opening roll, and further serves to clean the pressure roller (German Patent Publication DE-OS 2.130.658 which corresponds to U.S. Pat. No. 3,826,071). The fiber sliver in this device is supported by the driven feeding roll up to the point of transfer to the opening roll by the driven feeding roll. The filling element executes radial motions in the direction of the opening roll so that the distance between the guiding walls and the feeding roll changes. This does not permit secure guiding of the fiber sliver, so that fibers also get into the area of the lateral walls of the opening roll and risk producing fly. The fibers accumulating here are conveyed onto the spinning element, from time to time, in the form of fiber clumps. There is also the danger that, when the rolls are formed at the pressure roller, the filling element can be pushed up to the area of the clothing so that the clothing of the opening roll could be damaged.

SUMMARY OF THE INVENTION

It is the object of the instant invention to provide a device for the feeding and opening of a fiber sliver in such manner that, on the one hand, a uniform and fiber-preserving fiber feeding to the opening roll is achieved, and on the other hand, secure and timely guiding of the fiber sliver up to the area of the opening roll is made possible.

This object is attained through the invention in that the pressure roller is mounted in a feeding tray which has supporting surfaces, delimited by the lateral guiding walls, which support the fiber sliver is provided between the feeding roll and the opening roll. The fact that the lateral guiding walls are provided at the feeding tray ensures that the fiber sliver fed to the opening roller is always guided securely. The opening roll and the feeding roll are driven in the same direction of rotation. This also contributes to the fact that it is not the feeding roll which supports the fiber sliver on its way to the opening roll, but that this is done by the feeding tray. The pressure roller makes it possible to feed the fiber sliver uniformly in the direction of the opening roller over its entire cross-section, since the feeding roll no longer interacts with a counter-surface which is stationary in relation to the fiber movement, but with a pressure roller which rotates in the direction of fiber feeding.

The pressure roller is supported in the feeding tray, which is provided with a supporting surface for the fiber sliver after the pressure roller, as seen in direction of fiber feeding. Thus, a gap is formed between the pressure roller and the supporting surface for the sliver. To avoid the danger that the fibers and husk particles enter this gap, further embodiments of the invention provide for the supporting surfaces of the feeding tray to be inclined in relation to a tangent which is applied against the pressure roller and the arc of the supporting surface at which the fiber sliver being fed to the opening roll is deflected in its direction of rotation, whereby the end of the supporting surface towards the pressure roller is at a greater distance from the feeding roll than from the tangent. In this manner, the fiber sliver being fed to the opening roll does not enter the area of the beginning of the supporting surface and, therefore, neither enters the area of the above-mentioned gap, so that the danger of fibers and dirt particles being caught at that point is very small. To avoid the fiber and dirt particles becoming caught in the two end zones of the pressure roller between the latter and the guiding walls, it is also advantageous for the end of the guiding walls towards the pressure roll to be at a greater distance from the feeding roller than from the tangent.

The conveyance of the conveyor belt should be as uniformly as possible over the entire cross-section of the fiber sliver. For this reason it is advantageous for the pressure roller to follow the movement of the fiber sliver especially well. This is achieved particularly well in that the pressure roller is ribbed, whereby ribbing that is parallel to the axis of the pressure roller has proven especially well suited. Alternatively, and/or in addition, it is however also possible to provide an appropriate clothing or an appropriate covering for that purpose on the pressure roller. An especially uniform drive over the entire cross-section area of the fiber sliver is achieved if the pressure roller can be positively driven at the same circumferential speed as the feeding roll in the opposite direction of rotation. In this way, the staple fiber sliver is driven by the feeding roll as well as by the pressure roll in the direction of the opening roll.

It may occur that despite appropriate preventive measures, fibers and dirt particles do enter the area where the supporting surfaces begin. To avoid the danger that these particles enter the gap between the beginning of the supporting surfaces and the pressure roller, another advantageous embodiment of the invention provides that the supporting surfaces be provided with a stripping edge on their side towards the pressure roller.

To prevent dust and small fiber and dirt particles from settling between the pressure roller and the feeding tray, it has been shown to be advantageous to provide the feeding tray with a recess on its side away from the feeding roll, following the pressure roller. In this recess such particles can accumulate or can be removed from the recess. For this purpose the recess preferably extends up to the side of the feeding tray, away from the feeding roll. It is advantageous if the recess becomes wider in the direction going from the pressure roller to the outer wall of the feeding tray.

In order to avoid having to remove dust and other accumulations which have entered the recess by hand, the latter is connected, in an advantageous embodiment of the object of the invention, to a source of compressed air or to a source of suction air. This source of compressed or suction air produces, appropriately, intermittent air streams by means of which the removal or collection of the accumulations can be carried out very reliably.

In order to be able to strip off dust or other particles that may still adhere to the pressure roller, a stripping edge assigned to the pressure roller is suitably provided in the recess. The stripping edge is made in form of a replaceable insert on the supporting surface or in the recess, it having been found to be advantageous to make the stripping edge of spring steel sheet.

In particular when the feeding tray is provided with a recess extending on its side away from the pressure roller all the way to the outside, it is advantageous for the feeding tray to be spring-loaded by a leaf spring in the direction of the feeding roll, outside of the recess.

For some purposes it has proven to be advantageous for the pressure roll to be supported in a pendulum fashion in the feeding tray, so that the pressure roller can adapt automatically to oscillations of the width of a band.

The invention is simple in design and can easily replace existing, conventional feeding trays, even in an existing machine. The invention makes it possible to reduce the friction on the clamping wall across from the feeding roll, so that the fiber sliver can be conveyed uniformly over its entire cross-section to the opening roll. This is especially important when shutting down the feeding device, since in this way a definite stoppage of the fiber sliver can be achieved, independently of the material. This is of special significance when resuming operation of the feeding device, since the stream of fibers arriving at the spinning element starts up at a definite point in time. This definite stoppage and start-up makes it possible to produce piecing joints that are more uniform in strength as well as in appearance.

BRIEF DESCRIPTION OF THE DRAWINGS

The instant invention is explained in greater detail through several embodiments and drawings where.

DETAILED DESCRIPTION OF THE INVENTION

Figure 1:
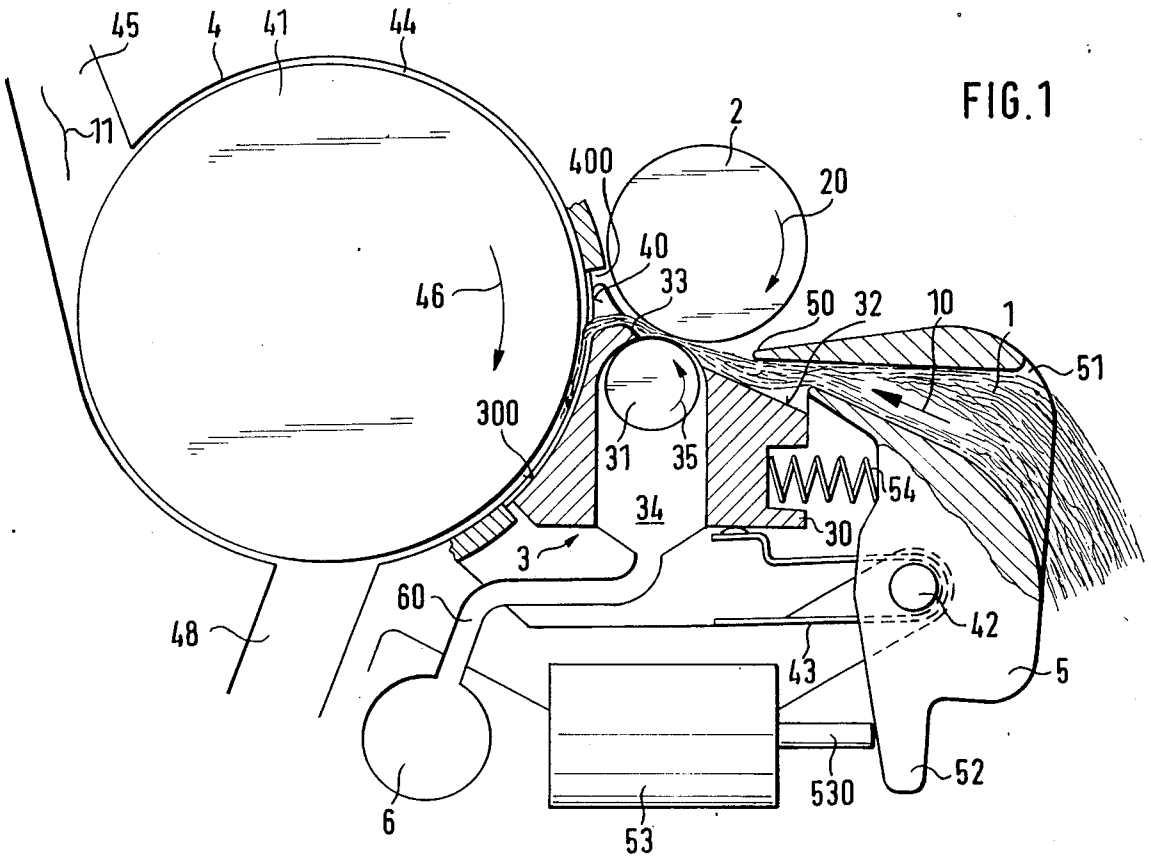
FIG. 1 is a side view, partly in section which shows a feeding and opening device according to the invention, for an open-end spinning device with a feeding tray connected to a source of suction air.

A first embodiment of the device for the feeding and opening of a fiber sliver 1 shall be explained first through FIG. 1. This device is equipped with a feeding roller 2 driven in the conventional manner which works together with a loading element 3. The loading element consists of a feeding tray 30 in which a pressure roller 31 is mounted in such manner that it can be brought to bear against the feeding roller 2. For that purpose the feeding tray bears with a sliding surface 300 against a guiding wall 40 which is part of a housing 4 containing an opening roll 41. This guiding wall 40 is provided with an opening 400 through which the fiber sliver 1 can be brought within working range of the opening roll 41.

The feeding tray 30 is provided with a guiding surface 32 located in front of the pressure roller 31, as seen in the direction of movement of the fiber sliver 1 defined by an arrow 10, and with a supporting surface 33 behind the pressure roller 31. The clamping end 50 of a clamping lever 5, which is pivotably mounted on a pivot axle 42 supported on the housing 4, interacts with the guiding surface 32. The clamping end 50 of the clamping lever 5 is provided with a feeding funnel 51 for the fiber sliver 1. The end 52 (away from the clamping end 50) interacts with armature 530 of a solenoid 53 which is also supported by the housing 4.

The feeding tray 30 is pressed by means of a pressure spring 54 against the guiding wall 40 of the housing 4. Pressure spring 54, which bears upon the arm of the clamping lever 5, with the clamping end 50 also holds the end 52 of the clamping lever 5 in contact against the armature 530 of the solenoid 53.

The feeding tray 30 is, furthermore, spring-loaded by means of a U-shaped, bent leaf spring 43, one end of which bears upon the underside of feeding tray 30 away from feeding roller 2 and the other end of which bears upon the part of housing 4 which supports the pivot axle 42. In this way the feeding tray 30 is pressed against the feeding roller 2 together with the pressure roller 31 which it supports.

A recess 34 is provided in the feeding tray 30, extending up to the pressure roller 31 and having essentially the same cross-sectional surface at its end towards the pressure roller 31 as said pressure roller. This recess widens as the distance to the pressure roller 31 increases and extends down to the outside of the feeding tray 30. At that location a hose 60, connected to a source of suction air 6, is connected to the recess 34.

A fiber feeding channel 45 is connected to the interior space 44 of the housing 4 which contains the opening roll 41, and through said fiber feeding channel 45, the fibers 11 separated from the fiber sliver 1 are fed to a spinning element (not shown) which could be in form of a spinning rotor, for example.

Figure 3:
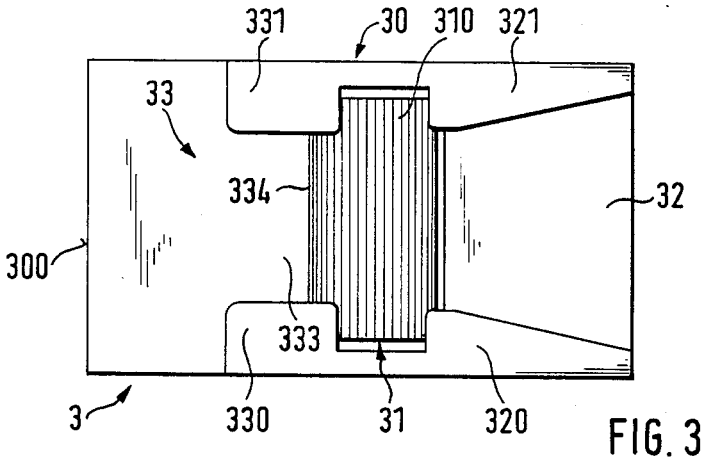
FIG. 3 is a top view of a feeding tray designed in accordance with the invention.

As shown especially clearly in FIG. 3, the feeding tray 30 is equipped with guiding walls 320 and 321 or 330 and 331, as seen in the direction of fiber conveyance on either side of the guiding surface 32 and of the supporting surface 33, as seen in the direction of fiber conveyance shown by the arrow 10.

The fiber sliver 1 to be spun is fed to the feeding device, consisting of the feeding roller 2 and the loading element 3, through the feeding funnel 51 in the clamping lever 5, and is at the same time held together by the lateral walls of the feeding funnel 51. When the fiber sliver 1 emerges from the feeding funnel 51 it is located between the guiding walls 320 and 321 of the feeding tray 30. The fiber sliver 1 then passes between the feeding roller 2 and the pressure roller 31. The feeding roller 2 rotates in the direction of the arrow 20. The moving fiber sliver 1 causes the pressure roller 31 to rotate in the direction of arrow 35 so that said pressure roller 31, thereby, moves into contact with the fiber sliver 1 at the same speed as said fiber sliver 1.

The fiber sliver 1 now reaches the supporting surface 33, between the guiding walls 330 and 331, and finally comes into working range of the opening roll 41. The clothing of the opening roll 41 (not shown) acts upon the forward end of the fiber sliver 1 and thereby separates fibers 11 from the forward end of the fiber sliver 1. At the same time, traction is exerted upon fiber sliver 1, holding the fiber sliver 1 stretched between the pressure roller 31 and the area 333 of the supporting surface 33 at which area the fiber sliver 1 is deflected in the direction of rotation of the opening roll 41, as shown by an arrow 46. This tension prevents the fiber sliver 1 from continuing to follow the rotation of the pressure roller 31 shown by arrow 35, so that, as a rule, no fibers 11 come between the pressure roller 31 and the end 334 of the supporting surface 33 on the side of the pressure roller 31. If, nevertheless, individual fibers 11 or dust and husk particles enter this gap 38 they are sucked out of the gap by the negative pressure produced by the suction air source 6 in the recess 34, and are removed.

As FIG. 1 clearly shows, the feeding roller 2 and the opening roll 41 rotate in the same direction of rotation indicated by the arrows 20 and 46. As a result, the fiber sliver 1 is pulled away from the feeding roller 2 and against the supporting surface 33. This ensures that the fiber sliver 1, fed to the opening roll 41, is held between the guiding walls 330 and 331 and is securely guided by guiding walls 330 and 331. In this way a confined feeding of the fiber sliver 1 to the opening roll 41 is also ensured in width.

If the feeding of the fiber sliver 1 to the opening roller 41 is interrupted as a result of a yarn breakage or when the spinning device or rail is shut off, the solenoid 53 is energized. This pivots the clamping lever 5 in such a manner that its clamping end 50 comes into contact with the guiding surface 32 of the feeding tray 30 and that the fiber sliver 1 becomes clamped between said clamping end 50 and said guiding surface 32. As this pivoting movement of the clamping lever 5 occurs, the feeding tray 30 is also removed from the feeding roll 2 together with the pressure roller 31 it supports, so that the fiber sliver 1 is no longer subjected to the conveying effect of the feeding roller 2 which continues to rotate.

Due to the fact that the low friction between fiber sliver and pressure roller 31 had caused the fiber sliver 1 to be conveyed equally well essentially over the entire cross-sectional area in the direction of the opening roll 41, the fiber sliver 1 or its fiber tuft assumes a defined, stretched position across from the feeding tray 30 and opening roll 41. That position is also independent of the material of the sliver, i.e., of the staple fiber length and of the adhesion forces between fiber material and loading element 3.

When the fiber sliver is released after a period of immobility through the release of the solenoid 53 and the backward pivoting of the clamping lever 5, fiber feeding to the opening roll 41, and thereby to the spinning element (not shown) is resumed to a defined degree. In this way defined piecing joints are produced, whose resistance to tearing and evenness can be predetermined with precision. To obtain the best possible piecing result, either the time between the last stoppage of fiber feeding to the opening roll 41 and the resumption of fiber feeding must be determined exactly, or the piecing program must be adapted to vary stoppage times of the fiber feeding. As mentioned earlier, a defined position of the fiber sliver 1 on the feeding tray 30 is produced by feeding the fiber sliver 1 to the opening roll 41 by means of a feeding roller 2 and a pressure roller 31 interacting with same, whereby the location of the pressure roller 31 in the feeding tray 30 (provided with guiding walls 320 and 321) ensures that the width of the fiber sliver 1 being fed to the opening roll 41 is precisely defined, without danger of the edges of the fiber sliver 1 becoming caught.

Figure 2:
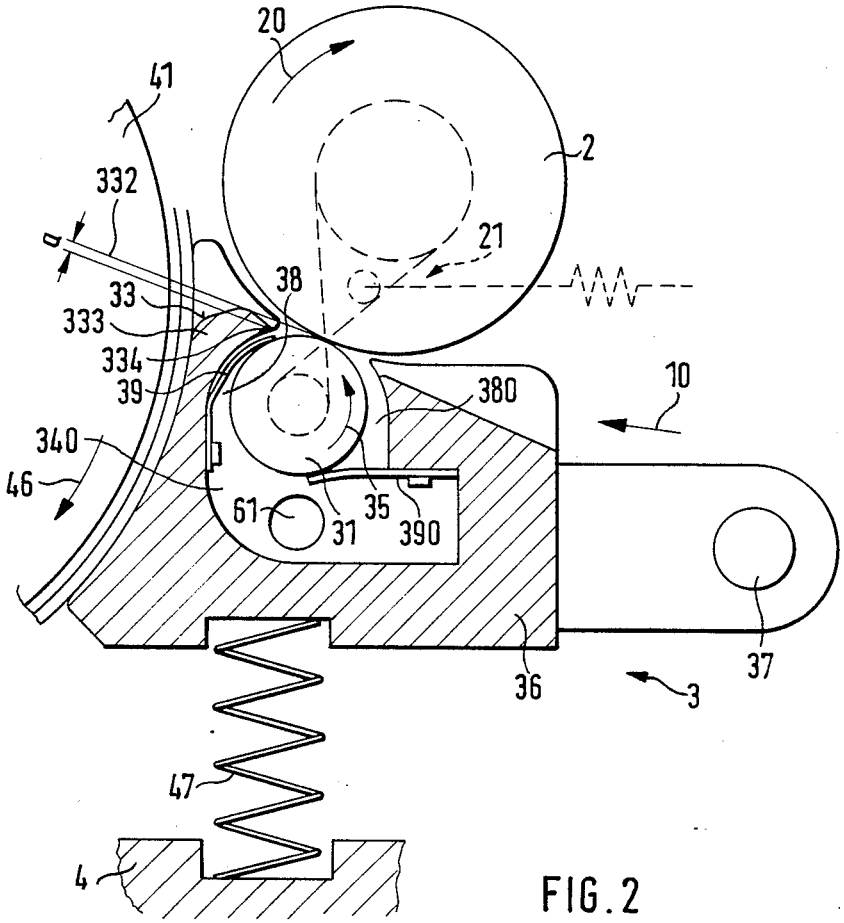
FIG. 2 shows a variant of the device shown in FIG. 1, with a feeding tray attached to a source of compressed air.

It is not necessary for the feeding tray to bear slidingly against a guiding wall 40 of the housing 4. As FIG. 2 shows, it is possible to mount the loading element 3 which consists essentially of a feeding tray 36, and of a pressure roller 31 pivotably on a pivot axle 37 which can, at the same time, serve as the bearing for the clamping lever 5 mentioned in connection with FIG. 1. The feeding trough 36 is loaded by a pressure spring 47 in a known manner and bears appropriately upon a part of the housing 4.

To reduce the danger of individual fibers 11 or dirt particles such as husk remnants entering the gap 38 between supporting surface 33 and pressure roller 31, gap 38 is delimited by a scraping edge 39 as seen in the direction of movement of the fiber sliver 1 (not shown) indicated by the arrow 10. This causes particles adhering to the pressure roller 31, or at least a major part of them, to be scraped off so that they are carried away by the fiber sliver 1 and are conveyed to the opening roll 41. According to FIG. 2, this scraping edge consists of an insert made of spring steel sheet metal, so that the scraping edge 39 can be easily replaced on the one hand, and can be easily adjusted on the other hand.

In the embodiment shown in FIG. 2 an additional stripping edge 390, interacting with the pressure roller 31 and also capable of being adjusted and replaced is provided in the recess 340 of the feeding tray 30 on the side of pressure roller 31 away from the feeding roll 2. If fibers, dust particles, husk particles or other particles were to enter the recess 340 and were to adhere to the surface of the pressure roller 31, these particles are stripped off by the stripping edge 390 and are removed by the air stream prevailing in the recess 340.

The feeding tray 36 is guided (in a manner not shown) between two sections of a compressed air duct 61 by means of which a stream of compressed air is guided parallel to the axle of the pressure roller 31 through the recess 340, which removes dirt or fiber particles that may have accumulated therein. This stream of compressed air may act continuously or intermittently, just as the suction air stream described in connection with FIG. 1 can be applied continuously or intermittently to the recess 34.

FIG. 2 shows yet another measure by means of which the danger of fibers or dirt particles entering the gap 38 is reduced. If a tangent 332 is applied to the circumference of pressure roller 31 towards the feeding roll 2 and to the area 333 of the supporting surface 33 at which the fiber sliver 1 being fed to the opening roll 41 is deflected in direction of rotation of the opening roll 41 as indicated by an arrow 46, the supporting surface 33 is inclined in relation to tangent 332 according to FIG. 2. This inclination is selected so that the end 334 of the supporting surface on the side of the pressure roller 31 does not reach all the way to the tangent (see interval a) but is at a greater distance from the feeding roll 2 by comparison with tangent 332.

If a fiber sliver 1 is fed to the opening roll 41 by means of the feeding device constituted by the feeding roller 2 and the loading element 3, the fiber sliver 1 is conveyed along a path that essentially coincides with the tangent 332 because of the tension created by the rotation of the opening roll 41. The fiber sliver 1 thus does not come into contact with the supporting surface 33 in the area of the end 334 of supporting surface 33 but is held away from it at a distance a. Since the fiber sliver 1 is unable to stretch laterally or upwardly upon leaving the nip constituted by the contact line 332 between the feeding roll 2 and the pressure roll 31, the fiber sliver comes into contact with the supporting surface 33 even before reaching the area 333, but not so long before that the fibers 11 contained in the fiber sliver 1 can enter gap 38. Only fiber components and dirt particles which have already come loose from the fiber sliver 1 (in particular, due to the compression effect which is caused by the compression of the fiber sliver between the feeding roll 2 and the pressure roller 31) and which adhere to the pressure roller 31 can go through the gap 38 and into the area of the air stream produced in recess 340 and are thus removed.

As shown in FIGS. 2 and 3, the pressure roller 31 extends laterally beyond the guiding walls 330 and 331. To prevent fibers sticking out laterally from the fiber sliver 1 from entering the space between the pressure roller 31 and the beginning of the guiding walls 330 and 331, the ends of said guiding walls 330 and 331 on the side of the pressure roller 31 are located at a greater distance from the feeding roller 2 than from tangent 332 (see FIG. 2). Due to tension in the fiber sliver 1 which is caused by the rotation of the opening roll 41, fibers 11 extending from fiber sliver 1 are prevented from entering into the range of the guiding walls 330 and 331 and coming between the walls and the pressure roller 31.

In the embodiments described, the pressure roller 31 is driven by the moving fiber sliver 1. The pressure roller 31 is provided with a surface proper to provide good friction contact with the fiber sliver. For this purpose the pressure roller 31 is provided with an appropriate covering or coating, made of rubber or similar material for example. It has however proven particularly advantageous for the pressure roller 31 to be given a certain roughness, whereby this roughness of the pressure roller 31 (as shown in the embodiment of FIG. 3) can be obtained through ribbing 310 which, in the preferred embodiment shown in FIG. 3, runs parallel to the axis of the pressure roller 31.

An alternate embodiment of the rotational drive of the pressure roller 31 is indicated by broken lines in FIG. 2. Here, the pressure roller 31 together with the feeding roll 2 is connected via an appropriate belt 21 to the drive of the feeding roll 2 in such a manner that the feeding roll 2 is driven in the direction of arrow 20 and the pressure roller 31 in the direction of arrow 35, i.e., in opposite direction. Thus, both the feeding roll 2 as well as the pressure roller 31 impart to the fiber sliver 1 a movement component in the direction of arrow 10. Thereby, especially uniform fiber feeding to the opening roll 41 is achieved, since slippage losses which could be created through the positive drive of the pressure roller 31 due to sliding of the fiber sliver 1 are avoided.

As the above description shows, the device for the feeding and opening of a fiber sliver 1 at an open-end spinning device can be modified in many ways. Thus, it is in particular possible to replace certain features of the device by others or to use the described features in different combinations. Neither is it always necessary to use all the features shown at one time. Thus, as FIG. 1 shows, it is possible to omit the stripping edge 39 and/or also the stripping edge 390, in particular, if the pressure roller has a profiled surface, so as to avoid damage of the surface of the pressure roller or of the stripping edge.

On the other hand, it is also not necessary to produce an air stream on the side of the pressure roller 31 away from the feeding roller 2. It would be sufficient to design the recess 34 so that fiber and dirt particles go from it to a removal device, e.g., a conveyor band provided with a clothing, or to design the recess 34 itself in form of a collecting container which can be emptied from time to time. The configuration of the recess 34 can also be different from that shown.

When an air stream is produced in the recess 34 it can be directed against the pressure roller 31 in order to prevent the penetration of fiber and dirt particles into the gap 380 before, or into the gap 38, after the pressure roller 31. On the other hand, it may be advantageous to use a stream of suction air instead of a stream of compressed air, not to prevent the emerging of such fiber particles and dirt particles but, on the contrary, to favor it in order to remove these components which are not usable for the spinning process and independently of the fact whether a dirt collection opening 48 is provided in the housing 4 between the fiber feeding point to the opening roll 41 and the fiber feeding channel 45.

As a comparison between FIGS. 1 and 2 shows, not only the special configuration and mounting of the feeding tray 30 or 36 plays no crucial role in the device described for the feeding and opening of a fiber sliver 1, but several springs to spring-load it are unimportant. Thus it is also possible to provide a pressure spring 47, as shown in FIG. 2, concentrically to a hose 60 as in FIG. 1, whereby said pressure spring 47 surrounds the hose 60.

Also the kind of drive control used for the fiber sliver 1 is without significance for the invention. Thus, instead of a controllable clamping lever 5, it is also possible to equip the feeding roller 2 with a coupling (not shown) by means of which the feeding roll 2 can be coupled to a drive or be uncoupled from same.

Figure 4:
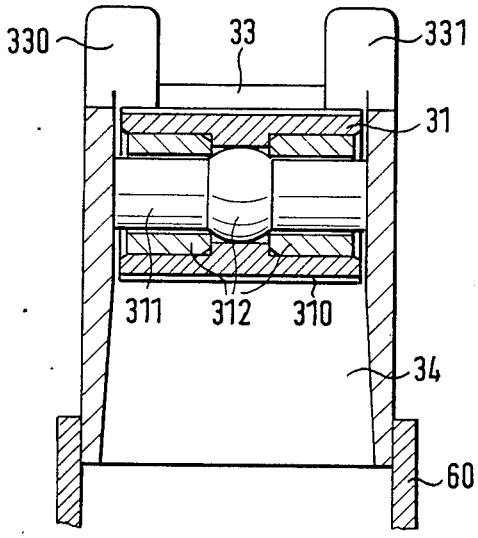
FIG. 4 shows a cross-sectional view through yet another embodiment of a feeding tray according to the invention.

FIG. 4 shows a cross-section through a pressure roller 31. In this embodiment the pressure roller 31 is mounted in pendulum fashion by means of a bolt 311 and of a tumbler bearing 312, so that the pressure roller 31 can adapt to the cross-sectional changes of the fiber sliver 1 over the latter's width. With such an arrangement of the pressure roller 31 in the feeding tray 30 or 36 the advantages described above are also obtained.

We claim:

1. A feeding device for feeding a fiber sliver to an open-end spinning device having an opening roll, comprising:

(a) a feed roll driven in a direction to feed said fiber sliver to said opening roll;

(b) a feed tray disposed opposite said feed roll for supporting said fiber sliver;

(c) a recess in said feed tray in communication with said feed roll;

(d) a pressure roll disposed in said recess in a position to press said fiber sliver into contact with said feed roll, and supported for rotation in a direction to assist said feed roll in feeding said fiber sliver to said opening roll; and (e) guide walls disposed on the sides of said feed tray adjacent to each end of said pressure roll for confining and guiding said fiber sliver between said feed roll and said pressure roll.

2. A feeding device as set forth in claim 1, wherein said feed tray has a fiber sliver supporting surface which is inclined with respect to a tangent drawn to the surface of said pressure roll and an area of said supporting surface whereat said fiber sliver is presented to said opening roll, at which area said fiber sliver is deflected in the direction of said opening roll rotation, and the end of said inclined supporting surface adjacent said pressure roll is at a greater distance from said feeding roll than from said tangent.

3. A feeding device as set forth in claim 2, wherein the ends of said guiding walls on the side of said pressure roll are at a greater distance from said feed roll than from said tangent.

4. A feeding device as set forth in claim 1, wherein the surface of said pressure roll is provided with longitudinal ribbing.

5. A feeding device as set forth in claim 4, wherein said ribbing extends parallel to the longitudinal axis of said pressure roll.

6. A feeding device as set forth in claim 1, wherein said pressure roll is provided with a covering.

7. A feeding device as set forth in claim 1, wherein said pressure roll is positively driven at the same surface speed and in the opposite direction as said feed roll.

8. A feeding device as set forth in claim 1, wherein a stripper edge is supported by said tray with an edge in contact with said pressure roll for stripping fiber and dust from the surface of said pressure roll.

9. A feeding device as set forth in claim 1, wherein said recess extends through said feed tray, about and below said pressure roll.

10. A feeding device as set forth in claim 9, wherein said recess extends to the side walls of said feed tray.

11. A feeding device as set forth in claim 10, wherein said recess becomes wider in the direction away from said feed roll.

12. A feeding device as set forth in claim 10, wherein said feed tray is supported for movement in the direction of said feed roll and is partially supported by a spring which urges it in the direction of said feed roll.

13. A feeding device as set forth in claim 12, wherein said spring is a leaf spring.

14. A feeding device as set forth in claim 1, wherein said recess is connected to a source of compressed air.

15. A feeding device as set forth in claim 14, wherein said compressed air is intermittently connected to said recess.

16. A feeding device as set forth in claim 14, wherein a stripping edge is supported within said recess and has an edge in contact with said pressure roll for stripping fiber and dust from the surface of said pressure roll.

17. A feeding device as set forth in claim 16, wherein said stripping edge is replaceably supported.

18. A feeding device as set forth in claim 16, wherein said stripping edge is made of spring sheet steel.

19. A feeding device as set forth in claim 1, wherein said recess is connected to a source of air under negative pressure.

20. A feeding device as set forth in claim 19, wherein said air under negative pressure is intermittently connected to said recess.

21. A feeding device as set forth in claim 1, wherein said pressure roll is supported in a pendulum fashion in said feed tray recess.

* * * * *